United States Patent [19]

Brown

[11] Patent Number: 4,869,173

[45] Date of Patent: Sep. 26, 1989

[54] BLASTING PLUG WITH PLATE MEMBERS AND PLASTIC RESIN

[76] Inventor: Joseph R. Brown, 624 Parkview Dr., Boonville, Ind. 47601

[21] Appl. No.: 237,435

[22] Filed: Aug. 29, 1988

[51] Int. Cl.[4] ..... F42B 3/00

[52] U.S. Cl. ..... 102/333; 102/312; 102/333

[58] Field of Search ..... 102/333, 312, 313

[56] References Cited

U.S. PATENT DOCUMENTS

| | | | |
|---|---|---|---|
| 1,627,991 | 6/1927 | Owen | 102/333 |
| 4,464,993 | 8/1984 | Porter | 102/333 |
| 4,464,994 | 8/1984 | Porter | 102/333 |

FOREIGN PATENT DOCUMENTS

| | | | |
|---|---|---|---|
| 3327038 | 2/1985 | Fed. Rep. of Germany | 102/333 |

*Primary Examiner*—Peter A. Nelson

*Attorney, Agent, or Firm*—Warren D. Flackbert

[57] ABSTRACT

A blasting plug used in conjunction with a drilled blasting hole and serving fill retaining purposes in a use condition. The blasting plug is an assembly of lightweight material, and serves as a substitute for inflatable air bags now in use and, thereby, represents a considerable cost reduction. Typically, the blasting plug is defined by plywood layers having one or more sections of plastic resin disposed therebetween. The invention presents an inexpensive blasting plug which satisfies operational needs.

3 Claims, 1 Drawing Sheet

BLASTING PLUG WITH PLATE MEMBERS AND PLASTIC RESIN

BACKGROUND OF THE INVENTION

As is known, various mechanics are utilized in connection with blasting, as, for example, at a coal mine site, and particularly in connection with what is termed pre-split blasting. In such instance, and typically, an inflatable air bag is utilized in the drilled hole for retaining fill at a preselected level. The preceding involves considerable cost, in view of the usual number of blasting sites and, as well, oftentimes fails to effectively maintain the desired seal with the wall of the blasting hole.

BRIEF DESCRIPTION OF PREFERRED EMBODIMENT

The invention satisfies a need in the above-described operation by presenting a plug which effectively retains the fill resulting from drilling action at a preselected level within a blasting hole. Briefly, the plug of the invention is a combination of layered plywood and lightweight expanded plastic, raised and/or lowered into position through the use of a rope secured to the plug.

In other words, the fill, deposited on the plug, is positively maintained in a preselected supported relationship, where the plug substantially covers the area of the drilled blasting hole. In this connection, the positive results combined with considerably less expense, in contrast to a commonly used air bag, is significant.

Figure 1:
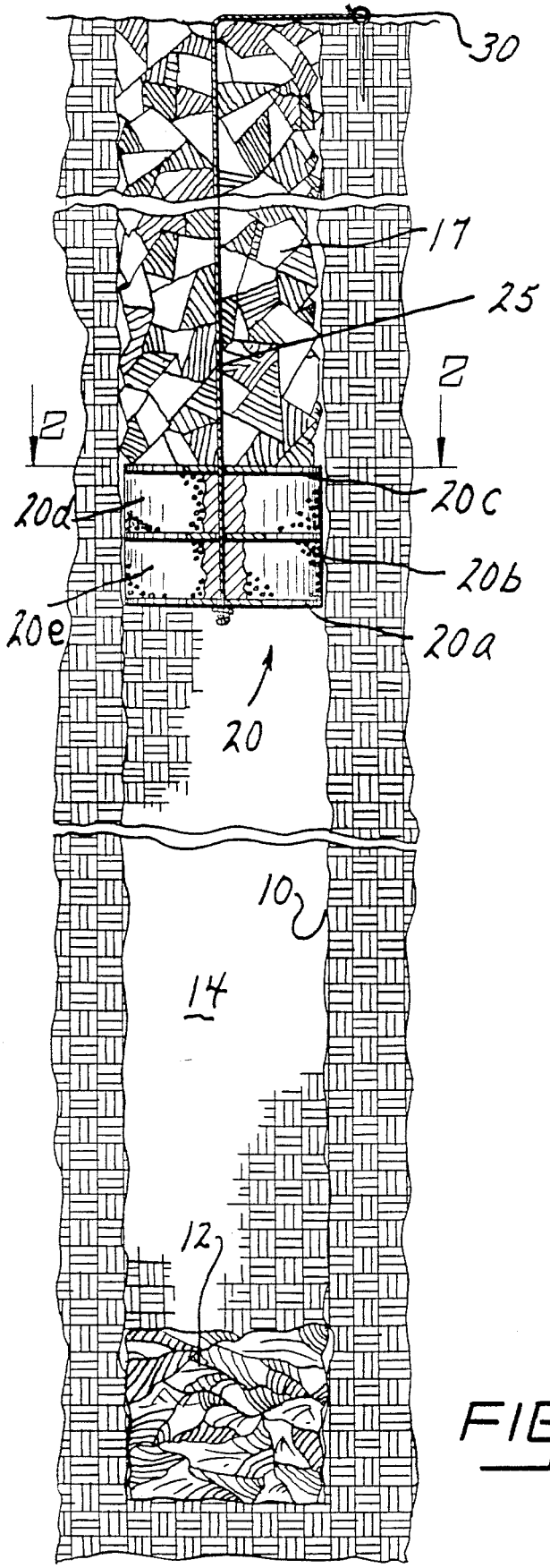
Figure 2:
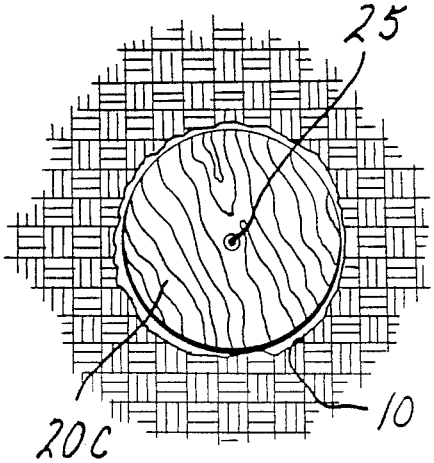

A better understanding of the present invention will become more apparent from the following description, taken in conjunction with the accompanying drawing, wherein FIG. 1 is a view in vertical section, partly fragmentary, showing a blasting plug, in an installed condition, in accordance with the teachings of the present invention; and, FIG. 2 is a view in horizontal section, taken at line 2—2 on FIG. 1 and looking in the direction of the arrows, further detailing the invention.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the blasting plug 20 of the invention is shown in connection with a typical drilled blasting hole 10, as commonly found at a coal mine location. Typically, the blasting hole 10 may have a depth of about 80 feet, and includes a powder charge 12 at the bottom thereof, perhaps, to a depth approximating 5 feet. An air space 14, about 55 feet in length, exists in the blasted hole 10 above the powder charge 12, terminating at blasting plug 20.

Fill 17, as that resulting from drilling the blasting hole 10, i.e. dust and/or cuttings, occupies the space above the blasting plug 20 (representatively 18 feet long) to the hole entry. As particularly evident in FIG. 1, the blasting plug 20 is retained in position by a cable or rope 25, typically polypropylene material, secured to the undersurface of the blasting plug 20 and extending upwardly through such, the fill 17 and then outwardly to a stake 30 driven into the ground adjacent the blasting hole 10.

As to the blasting plug 20, such is light in weight and typically includes, in a layered arrangement, a bottom horizontally disposed plywood wall 20*a*, an intermediate horizontally disposed plywood wall 20*b* and a top horizontally disposed plywood wall 20*c*, between which expanded plastic resin, such as styrofoam, is disposed in disc 20*d*–20*e* sections. The aforesaid rope 25 extends through openings in the various layers and terminates, commonly, at a knot below the bottom wall 20*a*.

In other words, the invention is quite apart from the use of a costly air bag, being represented as a lightweight blasting plug which is readily transportable, easily positioned in a use condition, and, as well, retained at such use condition without undue difficulty. The arrangement is such that the quantity of fill is easily maintained so that the blasting operation can be effectively completed.

The blasting plug described herein is susceptible to various changes within the spirit of the invention, including, by way of example, in proportioning; material selection, as for the mentioned walls and for the section(s) contained therebetween; the number of walls employed; the particular manner of raising and/or lowering the blasting plug; and, the like. Thus, the preceding should be considered illustrative and not as limiting the scope of the following claims:

I claim:

1. A blasting hole plug comprising a body defined as lightweight solid material disposed in a layered relationship, and means securing said body at a use location in a blasting hole in a fill supporting relationship, where said body of lightweight solid material is an assembly of plate members and plastic resin disposed therebetween.

2. The blasting hole plug of claim 1 where said securing means is a cable.

3. The blasting hole plug of claim 1 where said body has the same diameter at a use or at a non-use location.

* * * * *